US007398765B2

(12) United States Patent
Yamamoto

(10) Patent No.: US 7,398,765 B2
(45) **Date of Patent: *Jul. 15, 2008**

(54) FUEL INJECTION DEVICE OF INTERNAL COMBUSTION ENGINE

(75) Inventor: Yoshihisa Yamamoto, Kariya (JP)

(73) Assignee: Denso Corporation, Kariya, Aichi-Pref. (JP)

( * ) Notice: Subject to any disclaimer, the term of this patent is extended or adjusted under 35 U.S.C. 154(b) by 73 days.

This patent is subject to a terminal disclaimer.

(21) Appl. No.: 11/446,967

(22) Filed: Jun. 6, 2006

(65) Prior Publication Data

US 2006/0278199 A1 Dec. 14, 2006

(30) Foreign Application Priority Data

Jun. 9, 2005 (JP) ..... 2005-169478

(51) Int. Cl.
*F02M 47/02* (2006.01)

(52) U.S. Cl. ..... 123/467; 239/96

(58) Field of Classification Search ..... 123/446, 123/447, 510, 511, 467; 239/96
See application file for complete search history.

(56) References Cited

U.S. PATENT DOCUMENTS 5,622,152 A * 4/1997 Ishida ..... 123/446
6,453,875 B1 * 9/2002 Mahr et al. ..... 123/446
7,040,288 B2 * 5/2006 Nakayama et al. ..... 123/446
7,107,966 B2 * 9/2006 Tanabe et al. ..... 123/446
7,228,845 B2 * 6/2007 Yamamoto ..... 123/446
2005/0077378 A1 * 4/2005 Kropp et al. ..... 239/88
2005/0172935 A1 * 8/2005 Magel et al. ..... 123/446
2006/0065241 A1 3/2006 Yamamoto

FOREIGN PATENT DOCUMENTS

JP 2003-106235 4/2003
JP 2006-22673 1/2006

OTHER PUBLICATIONS

U.S. Appl. No. 11/282,698, filed Nov. 21, 2005, Yamamoto, Yoshihisa.
JP Application No. 2004-337879; Substantial English Translation.

* cited by examiner

*Primary Examiner*—Thomas N Moulis
(74) *Attorney, Agent, or Firm*—Nixon & Vanderhye PC

(57) ABSTRACT

A fuel injection device has a two-way control valve driven by a two-position actuator. The control valve directly controls oil pressure in a back pressure chamber to control an injection operation of an injection nozzle. A two-position three-way flow passage switching valve operated by control pressure of the control valve selectively connects a control chamber of a pressure intensifier with a fuel supply passage leading to a pressure accumulator or a pressure release passage leading to a low-pressure system to indirectly control oil pressure in the control chamber. The flow passage switching valve starts a pressure intensifying operation in retard of the injection operation. When pressure is supplied to the control chamber, stoppage of the pressure intensification operation and returning operation of the pressure intensifier do not lag behind the injection operation.

12 Claims, 9 Drawing Sheets

FUEL INJECTION DEVICE OF INTERNAL COMBUSTION ENGINE

CROSS REFERENCE TO RELATED APPLICATION

This application is based on and incorporates herein by reference Japanese Patent Application No. 2005-169478 filed on Jun. 9, 2005.

BACKGROUND OF THE INVENTION

1. Field of the Invention

The present invention relates to a fuel injection device of an internal combustion engine, specifically, a diesel engine. Specifically, the present invention relates to a fuel injection device that has a pressure intensifying mechanism.

2. Description of Related Art

A common rail system is known as a fuel injection device for a diesel engine. The common rail system has a common pressure accumulator to accumulate pressurized fuel pressure-fed from a fuel supply pump and injects the accumulated fuel into respective cylinders by opening and closing injection nozzles with oil pressure control valves. The common rail system has excellent properties such as an ability to control injection pressure and injection amount independently.

In recent years, further improvement of performance of the common rail system has been required from the viewpoint of exhaust emission purification or fuel consumption improvement. In order to respond to this requirement, a newly proposed system has a pressure intensifying mechanism that raises the fuel injection pressure and a mechanism that controls a nozzle opening-closing operation with oil pressure, which is an advantage of the common rail system, for example, as described in Japanese Patent No. 2885076.

This fuel injection device can perform the injection at higher pressure than before with the use of the pressure intensifying mechanism. In addition, this system can change the injection pressure in one injection cycle by controlling both of the pressure intensification and the injection. Further, this fuel injection system enables multiple injection modes such as a minute amount injection at low pressure or a main injection at extra-high pressure. Accordingly, fine control corresponding to an operating state can be performed to optimize combustion.

Since this kind of system essentially has to control the two operations, i.e., the pressure intensifying operation and the injection operation, respectively and independently, the system has to have at least two actuators. Accordingly, the structure of the system tends to be complicated, increasing a cost. It has been required to realize the similar function with an easier structure.

Another system described in JP-A-2003-106235 selectively opens and closes flow passages leading to a nozzle back pressure chamber and a pressure intensification control chamber with a control valve. A degree of control freedom is limited, but only one actuator is used and an entire structure is simplified.

FIG. 11 is a schematic diagram showing the fuel injection device described in JP-A-2003-106235. The fuel injection device 1 has a pressure accumulator 10, a pressure intensifier 20, an injection nozzle 30, a check valve 40 and a control valve 50 for controlling operations of the parts 10-40. The pressure intensifier 20 intensifies pressure of fuel in a high-pressure chamber 24 by driving a pressure intensifying piston provided by a large diameter piston 21 and a small diameter plunger 22 and supplies the fuel to the injection nozzle 30. Several restrictors are provided in fuel passages connecting the parts 10-50. For example, a control chamber 25 of the pressure intensifier 20 communicates with the pressure intensifier 10 through a restrictor 91 and communicates with the control valve 50 through a restrictor 92. Thus, pressure supply to the control chamber 25 and pressure release to a low-pressure system are controlled. A back pressure chamber 34 of the injection nozzle 30 communicates with the pressure accumulator 10 through restrictors 91, 92, 93 and communicates with the control valve 50 through the restrictor 93. Thus, pressure supply to the back pressure chamber 34 and pressure release to the low-pressure system are controlled.

In the above-described structure of the related art, the single control valve 50 controls pressures of the two chambers, i.e., the control chamber 25 of the pressure intensifier 20 and the back pressure chamber 34 of the injection nozzle 30. Therefore, the above structure is provided as an oil pressure circuit for connecting these elements. Even if the three restrictors 91, 92, 93 are used, it is difficult to optimize all of the pressures. When the control valve 50 is opened, a large amount of the fuel is continuously discharged from the pressure accumulator 10 due to the pressure intensifying control. Characteristics of a pressure-feeding stroke and a returning stroke of the pressure intensifier 20 can be set respectively but restrictor values are subject to restraint because the characteristics are not independent of injection characteristics. As a result, the optimization becomes further difficult.

As described above, the pressure in the control chamber 25 of the pressure intensifier 20 and the pressure in the back pressure chamber 34 have to be controlled. However, since the oil pressure circuit connects these chambers 25, 34 with each other, the pressure intensifying operation and the injection operation occur at the same time necessarily. Therefore, the injection cannot be performed at low pressure, i.e., without intensifying the pressure. As a result, multi-step injection at low pressure, which is preferable from the viewpoint of exhaust emission purification, cannot be performed, for example. Optimization of combustion through more sophisticated control has been required.

SUMMARY OF THE INVENTION

It is an object of the present invention to provide a high-performance and inexpensive system that uses a simple two-position actuator capable of performing pressure intensifying control and injection control with a high degree of freedom at high accuracy while preventing performance degradation such as reduction of a control freedom degree, which can be caused by using the single actuator, and while preventing continuous and wasteful discharge of pressure of pressure intensifier operation oil.

According to an aspect of the present invention, a fuel injection device for an internal combustion engine has a pressure accumulator, a pressure intensifier, an injection nozzle, a control valve and a flow passage switching valve. The pressure accumulator accumulates fuel under pressure. The pressure intensifier operates a pressure intensifying piston with oil pressure in a control chamber to intensify the pressure of the fuel supplied from the pressure accumulator to a high-pressure chamber. The injection nozzle injects the fuel supplied directly from the pressure accumulator or the fuel, the pressure of which is intensified by the pressure intensifier. Opening and closing of the injection nozzle is controlled by oil pressure in a back pressure chamber thereof. The control valve controls the pressure intensifying operation of the pressure intensifier and the injection operation of the injection nozzle. The control valve is a two-way control valve driven by a two position actuator and directly controls the oil pressure in the back pressure chamber to control the injection operation of the injection nozzle. The flow passage switching valve has a two-position three-way valve structure operated by control pressure controlled by the control valve. The control chamber is selectively connected with a supply passage extending from a pressure supply source or with a pressure release passage leading to a low-pressure system through the flow passage switching valve to indirectly control the oil pressure of the control chamber. Thus, the pressure intensifying operation of the pressure intensifier is controlled. The flow passage switching valve is structured so that a start of the operation thereof is delayed until the control pressure decreases to a predetermined operation pressure when the pressure is released from the control chamber to perform the pressure intensifying operation. Thus, the pressure intensifying operation starts in retard of the injection operation. The control chamber is supplied with pressure through the pressure release passage during a delay of the operation of the flow passage switching valve with respect to the operation of the control valve when the pressure is supplied to the control chamber to stop the pressure intensifying operation. Thus, the pressure intensifying operation is stopped and a returning operation of the pressure intensifying piston is performed abreast of stoppage of the injection operation.

If the two-position actuator is energized, the control valve starts the injection operation. The flow switching valve does not operate until the oil pressure in the control chamber decreases to the predetermined operation pressure. Therefore, by stopping the injection during the delay, a minute amount injection at pressure not intensified can be performed. If the delay elapses, the pressure intensifying operation is started, so the high-pressure fuel, the pressure of which is intensified, can be injected. When the injection is ended, the energization to the two-position actuator is stopped so that the pressure intensifying operation quickly stops and the pressure intensifying piston returns to its original position without delay. Accordingly, the pressure intensifier is not operated wastefully.

Thus, the control valve driven by the two-position actuator has a simple two-way valve structure and directly controls the injection operation. The flow passage switching valve that has a two-position three-way valve structure and has a delay in its operation is used to indirectly control the pressure intensifying operation. Thus, the injection operation and the pressure intensifying operation can be controlled sophisticatedly. Moreover, the control chamber is selectively connected with the supply passage extending from the pressure supply source or the pressure release passage leading to the low-pressure system. Accordingly, wasteful flow of the fuel caused when the both passages communicate with each other can be suppressed and the injection operation and the pressure intensifying operation are stopped substantially at the same time. Accordingly, a drive energy loss is inhibited.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF EXAMPLE EMBODIMENTS

Figure 1:
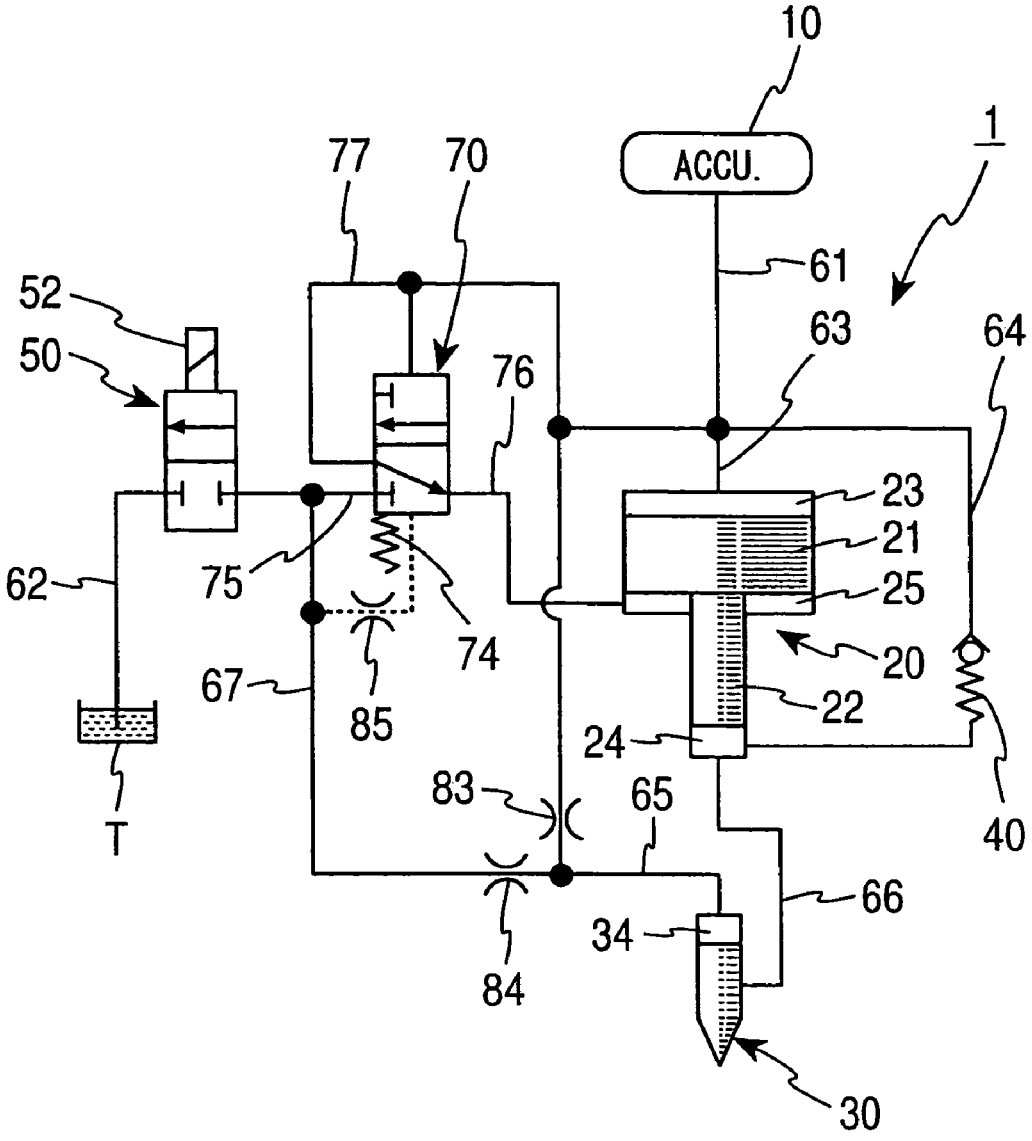
FIG. 1 is a schematic diagram showing a fuel injection device according to a first example embodiment of the present invention.

Referring to FIG. 1, a fuel injection device according to an example embodiment of the present invention is illustrated. In the example shown in FIG. 1, the present invention is applied to the fuel injection device 1 of a vehicular diesel engine. The fuel injection device has main components such as a pressure accumulator 10, a pressure intensifier 20, an injection nozzle 30, a control valve 50 and a flow passage switching valve 70. The pressure accumulator 10 accumulates fuel under pressure. The pressure intensifier 20 intensifies the pressure of the fuel supplied from the pressure accumulator 10. The injection nozzle 30 directly injects the fuel supplied from the pressure accumulator 10 or injects the fuel, the pressure of which is intensified by the pressure intensifier 20. The control valve 50 controls operations of the pressure intensifier 20 and the injection nozzle 30. The flow passage switching valve 70 is operated by control pressure controlled by the control valve 50. Fuel passages 61-67, 75-77 are provided to connect these components with each other. A check valve 40 and restrictors 83, 84, 85 are provided in the fuel passages.

The pressure intensifier 20 has a pressure intensifying piston consisting of a large diameter piston 21 and a small diameter plunger 22. The pressure intensifier 20 drives the pressure intensifying piston with oil pressure of the control chamber 25 to pressurize the fuel supplied to a high-pressure chamber 24. The high-pressure chamber 24 is supplied with the fuel from the pressure accumulator 10 through the pressure supply passages 61, 64 and the check valve 40. Opening and closing of the injection nozzle 30 are controlled by oil pressure of a back pressure chamber 34 communicating with the pressure accumulator 10. Thus, the injection nozzle 30 injects the fuel supplied through the high-pressure chamber 24.

The control valve 50 is structured as a two-way valve driven by a two-position actuator 52. A control port of the control valve 50 is connected with a control chamber 25 of the pressure intensifier 20 through the flow passage switching valve 70 and is connected directly with the back pressure chamber 34 of the injection nozzle 30. A discharge port of the control valve 50 is connected with the pressure release passage 62 leading to a fuel tank T as a low-pressure system.

The flow passage switching valve 70 is a two-position three-way valve. A supply port of the flow passage switching valve 70 is connected with the pressure accumulator 10 and a release port of the flow passage switching valve 70 is connected with the control port of the control valve 50. A switching port of the flow passage switching valve 70 is connected with the control chamber 25 of the pressure intensifier 20. The flow passage switching valve 70 is operated by a pressure difference between the pressure in the pressure accumulator 10 and pressure in the control port of the control valve 50 to connect the switching port with the supply port or the discharge port in accordance with a position of the flow passage switching valve 70. The switching port is connected with the release port only when the pressure in the control port of the control valve 50 becomes lower than the pressure in the pressure accumulator 10 by at least a predetermined value. Otherwise,.the switching port is connected with the supply port.

By bringing the flow passage switching valve 70 to a supply state in an early stage of injection, injection characteristics can be set with the valve opening of the control valve 50 and with the restrictors 83, 84 independently from pressure intensifying control. In the later stage of the injection, the flow passage switching valve 70 is brought to a discharge state. Thus, pressure intensification characteristics can be set with a restrictor (not shown). The flow passage switching valve 70 is brought to the supply state in a returning stroke of the pressure intensifier 20. Thus, returning characteristics of the pressure intensifier 20 are set with a restrictor (not shown). Nozzle closing characteristics are set with the control valve 50 and the restrictor 83.

Figure 2:
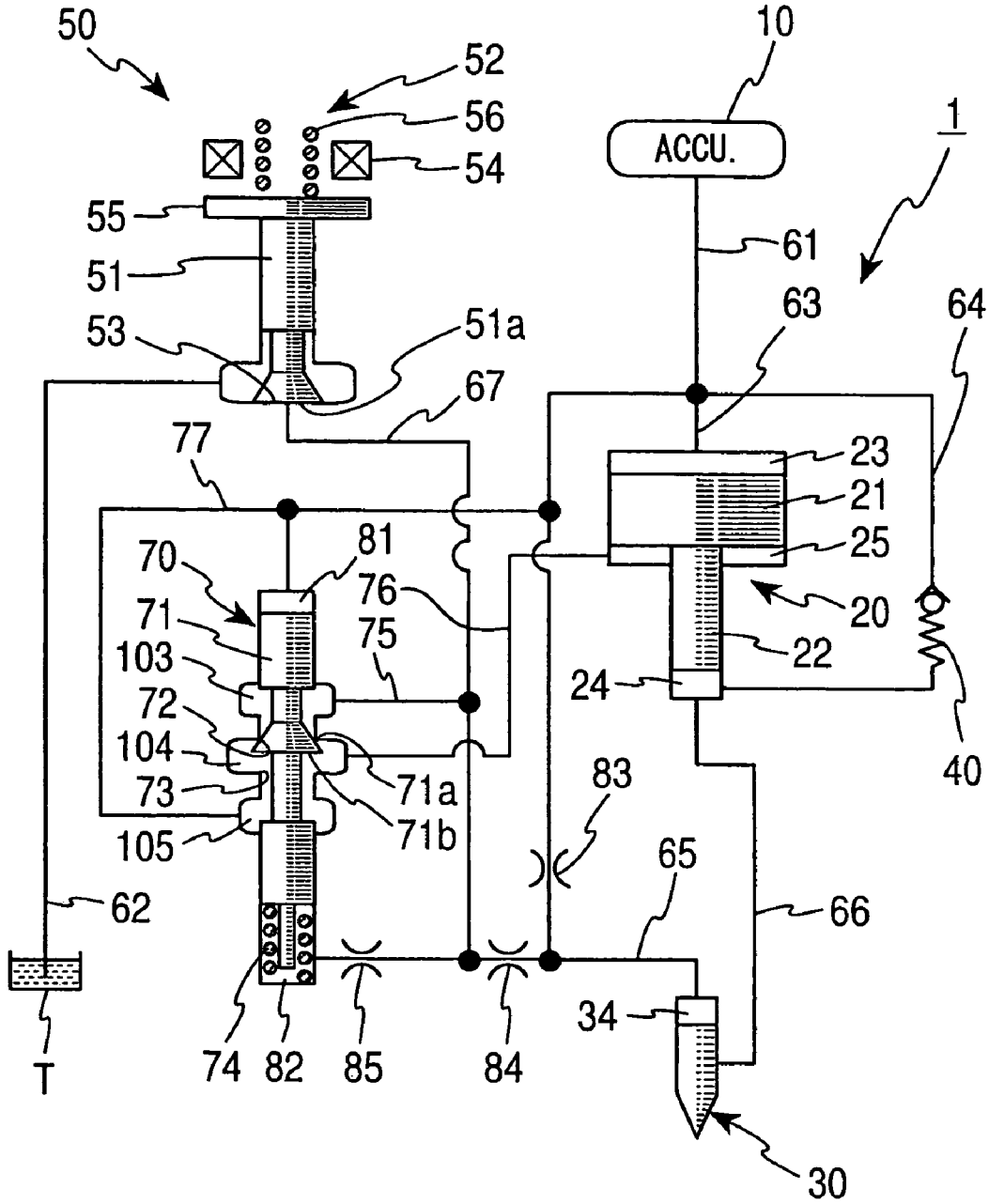
FIG. 2 is a schematic diagram showing an initial state of the fuel injection device according to the FIG. 1 embodiment.
Figure 5:
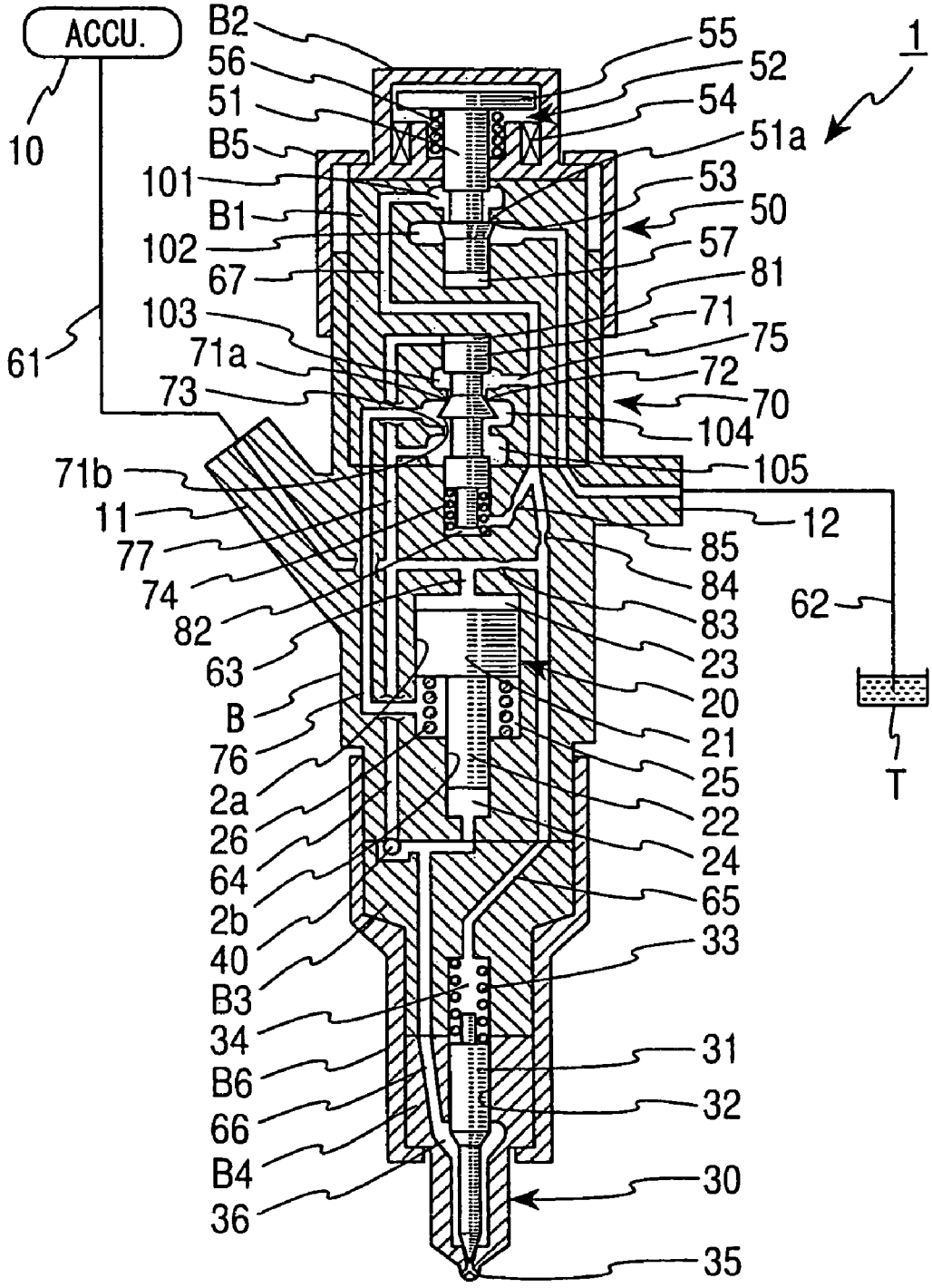
FIG. 5 is a sectional view showing the fuel injection device according to the FIG. 1 embodiment.

A specific example of the control valve 50 and the flow passage switching valve 70 of the FIG. 1 embodiment is shown in FIG. 2. An example of the entire structure of the fuel injection device 1 including these components is shown in FIG. 5. As shown in FIG. 5, the fuel injection device 1 has a body B, a first body B1, a second body B2, a third body B3 and a fourth body B4. The body B accommodates the pressure intensifier 20. The first and second bodies B1, B2 are provided on an upper end of the body B in FIG. 5 to accommodate the control valve 50 and the flow passage switching valve 70. The third and fourth bodies B3, B4 are provided below a lower end of the body B in FIG. 5 to define the injection nozzle 30. The body B and the first to fourth bodies B1-B4 are oil-tightly fixed by retainers B5, B6. A fuel introduction pipe 11 and a fuel leading pipe 12 protrude respectively from left and right sides of the body B in FIG. 5. The fuel introduction pipe 11 is connected with the pressure supply passage 61 leading to the pressure accumulator 10. The fuel leading pipe 12 is connected with the pressure release passage 62 leading to the fuel tank T.

The pressure accumulator 10 is supplied with the fuel pressurized by an already-known fuel pump (not shown) having a mechanism for varying a discharge amount. A controller (not shown) controls the discharge amount of the fuel pump to control the pressure of the fuel accumulated in the pressure accumulator 10. Thus, by using the pressure accumulator 10, stable pressure can be maintained regardless of an operating state. The fuel in the pressure accumulator 10 is supplied to the pressure intensifier 20 through the fuel passages 63, 64 branching from the pressure supply passage 61. At the same time, the fuel in the pressure accumulator 10 is supplied to the injection nozzle 30 through the fuel passage 61, 64 and the fuel passages 65, 66.

The large diameter piston 21 of the pressure intensifier 20 slides in a large diameter bore 2*a* while maintaining oil tightness. The small diameter plunger 22 of the pressure intensifier 20 slides in a small diameter bore 2*b* while maintaining oil tightness. The large diameter piston 21 and the small diameter plunger 22 slide in a vertical direction substantially integrally while conforming axes thereof to each other, functioning as a pressure intensifying piston. An upper end face of the large diameter piston 21 (end face opposite from the small diameter plunger 22) and an upper end inner peripheral face of the large diameter bore 2*a* define a drive chamber 23. The high-pressure fuel is introduced from the fuel passage 63 into the drive chamber 23 to apply a downward oil pressure to the pressure intensifying piston.

A lower end face of the small diameter plunger 22 (end face opposite from the large diameter piston 21) and a lower end inner peripheral face of the small diameter bore 2*b* define the high-pressure chamber 24. The high-pressure chamber 24 communicates with a fuel sump 36 of the injection nozzle 30 through the fuel passage 66 and communicates with the fuel passage 64 through the check valve 40. The check valve 40 allows only a fuel flow directed toward the high-pressure chamber 24 and the injection nozzle 30. For example, the check valve 40 is provided by locating a ball-shaped valve member in a large diameter portion formed in the fuel passage 64. The valve member is normally biased in a valve closing direction upward by a return spring as shown in FIG. 2. In FIG. 5, the return valve is omitted.

A lower end face of the large diameter piston 21 (end face on the small diameter plunger 22 side), a lower end inner peripheral face of the large diameter bore 2*a* and an upper end outer peripheral face of the small diameter plunger 22 define the control chamber 25. A return spring 26 is located in the control chamber 25 for biasing the large diameter piston 21 upward. The pressure in the control chamber 25 is controlled by the flow passage switching valve 70 communicating with the control chamber 25 through the fuel passage 76. The pressure intensifying piston (large diameter piston 21 and small diameter plunger 22) slides in the bore in accordance with increase and decrease of the pressure in the control chamber 25. Thus, the fuel pressure in the high-pressure chamber 24 can be intensified.

The injection nozzle 30 has a needle valve 31 for opening and closing an injection hole 35 and the back pressure chamber 34 that applies the back pressure to the needle valve 31. The needle valve 31 slides in a bore 32 formed in the fourth body B4 in the vertical direction in FIG. 5 while maintaining oil tightness. The back pressure chamber 34 is defined by an upper end face of the needle valve 31 and an upper end inner peripheral face of the bore 32. A spring 33 is provided in the back pressure chamber 34 for biasing the needle valve 31 in a valve closing direction. Injection fuel is supplied from the fuel passage 66 to an injection hole 35 though the fuel sump 36 formed around a middle portion of the needle valve 31. The fuel passage 65 leading to the back pressure chamber 34 is connected with the fuel supply passage 61 leading to the pressure accumulator 10 through the restrictor 83. The fuel passage 65 is also connected with the fuel passage 67 as the pressure release passage leading to the control valve 50 through the restrictor 84.

The control valve 50 has two control functions. A valve member 51 slides in the vertical direction in FIG. 5 in a bore formed in the first body B1 while maintaining oil tightness to directly control the injection from the injection nozzle 30 and to indirectly control the drive of the pressure intensifying piston of the pressure intensifier 20. A disc-shaped armature 55 is connected to an upper end of the valve member 51. Thus, the armature 55 operates as a two position electromagnetic actuator 52 with an electromagnetic coil 54 and a return spring 56. The armature 55, the electromagnetic coil 54 and the return spring 56 are accommodated in the second body B2.

The valve member 51 has cylindrical sliding portions at both vertical ends. The valve member 51 further has a small diameter portion and an inverted circular cone portion in its middle portion. The inverted circular cone portion continues from the small diameter portion to provide a flat seat 51*a* at a step between the small diameter portion and the inverted circular cone portion. Circular grooves 101, 102 are formed on a bore inner peripheral face around the small diameter portion and the inverted circular cone portion. A flat seat 53 provided by a step between the circular grooves 101, 102 and the flat seat 51*a* function as a two-way valve to perform opening and closing operation. The circular groove 101 connected with the fuel passage 67 leading to the injection nozzle 30 or the flow passage switching valve 70 functions as the control port. The circular groove 102 connected with the pressure release passage 62 functions as the release port. Connection and disconnection of the ports 101, 102 are switched by the position of the valve member 51.

In the control valve 50 shown in FIG. 5, a chamber 57 formed below the lower end sliding portion of the valve member 51 is connected with a low-pressure circuit through a passage (not shown) to reduce a required attraction of the control valve 50 and to achieve a pressure balance.

In FIG. 2, a modified example of the control valve 50 is shown. The control valve 50 shown in FIG. 2 has a simpler structure, in which the lower end face of the circular cone portion continuing from the small diameter portion provides the flat seat 51*a* but the lower sliding portion is not provided. In the example shown in FIG. 5, the electromagnetic coil 54 and the return coil 56 are located below the armature 55 to attract the armature 55 downward. In the example shown in FIG. 2, the electromagnetic coil 54 and the return spring 56 are located above the armature 55 to attract the armature 55 upward. The structure shown in FIG. 2 has a similar function of opening the flat seat 53 to connect the control port with the low-pressure circuit.

In the flow passage switching valve 70, a valve member 71 slides in the vertical direction in the illustration in a bore formed in the first body B1 while keeping oil tightness. The valve member 71 has cylindrical sliding portions at both vertical ends and a circular cone portion between two small diameter portions in its middle portion. Three circular grooves 103-105 are formed on a bore inner peripheral face around the two small diameter portions and the circular cone portion. A flat seat 72 provided at a step between the circular grooves 103, 104, a flat seat 73 provided at a step between the circular grooves 104, 105, a circular cone seat 71*a* of the circular cone portion and a flat seat 71*b* of the circular cone portion operate as a three-way valve to perform a switching operation. The intermediate circular groove 104 communicates with the control chamber 25 of the pressure intensifier 20 through the fuel passage 76. The upper circular groove 103 communicates with the fuel passage 67 leading to the control port of the control valve 50 through the fuel passage 75. The lower circular groove 105 communicates with the fuel supply passage 61 leading to the pressure accumulator 10 through the fuel passage 77. The intermediate circular groove 104 functions as the switching port and is selectively connected with the upper circular groove 103 as the release port or the lower circular groove 105 as the supply port in accordance with the position of the valve member 71. Thus, the control pressure of the pressure intensifier 20 is switched.

The valve member 71 has a pressure chamber 81 communicating with the pressure accumulator 10 through the fuel passage 77 on its upper end portion. An operation chamber 82 formed on a lower end portion of the valve member 71 is connected with the fuel supply passage 67 leading to the control valve 50 through the restrictor 85 and the fuel supply passage 65 leading to the back pressure chamber 34 of the injection nozzle 30. A spring 74 is located in the operation chamber 82 to apply an upward load to the valve member 71. Thus, the upper end of the valve member 71 receives pressure of the pressure accumulator 10 and the lower end of the valve member 71 receives the pressure of the control port of the control valve 50 through the restrictor 85. A difference of the pressures and a biasing force of the spring 74 opposing the pressure difference operate the valve member 71. Accordingly, the flow passage switching valve 70 does not operate immediately after the control valve 50 opens. The flow passage switching valve 70 starts the operation after a delay. Operation pressure for the flow passage switching valve 70 to start the operation can be set by the biasing force of the spring 74 and an opening area of the restrictor 85. By changing the setting of the operation pressure, the delay of the switching operation can be adjusted.

The control valve 50 as the two-position actuator is structured as a two-way valve. The control valve 50 opens and closes to control the pressure in the back pressure chamber 34 of the injection nozzle 30. The control port of the two-way valve is connected with the control chamber 25 of the pressure intensifier 20 through the flow passage switching valve 70. The flow passage switching valve 70 is structured as a three-way valve. The switching port connected with the control chamber 25 is selectively connected with the pressure accumulator 10 or the control port of the control valve 50.

Thus, there is no wasteful and continuous discharge of fuel except for slight leakage caused when the control valve 50 is opened (during injection period). Since the flow passage switching valve 70 of the pressure intensifier 20 does not operate until the pressure becomes equal to or lower than the set pressure as described above, the injection can be performed at pressure not intensified. Thus, a freedom degree of control of the pressure intensifying characteristics and the injection characteristics is improved.

Figure 3:
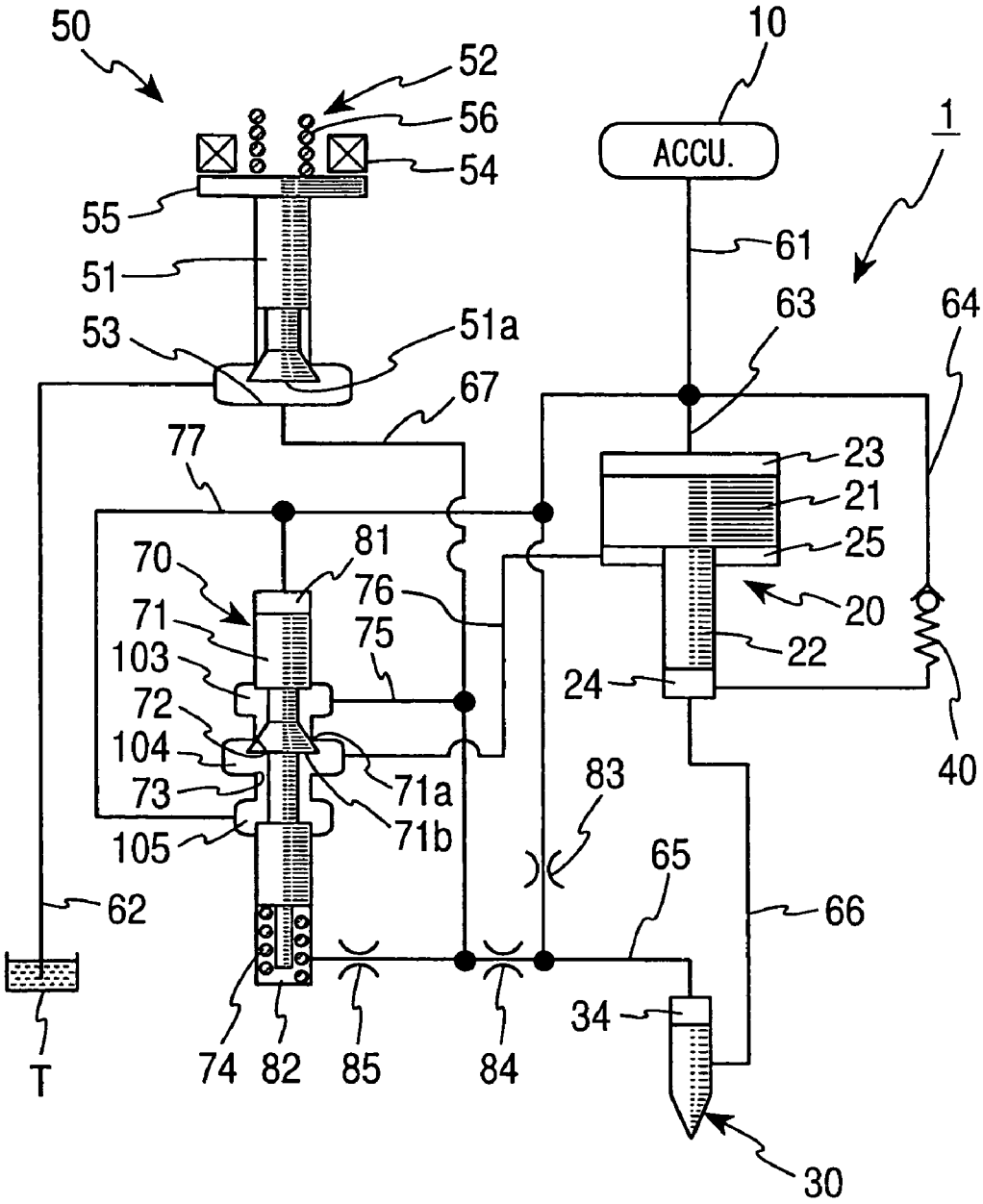
FIG. 3 is a schematic diagram showing an injection controlling state of the fuel injection device according to the FIG. 1 embodiment.

Next, an operation of the fuel injection device 1 according to the present embodiment will be described in reference to FIGS. 2 to 4. FIG. 2 shows a state in which the valve member 51 of the control valve 50 is positioned at an initial position due to the return spring 56. In this state, the control valve 50 is in a closed state in which the flat seat 51*a* is seated on the seat 53. In this state, the communication between the fuel passage 67 and the pressure release passage 62 is broken, so the pressure in the back pressure chamber 34 of the injection nozzle 30 is not discharged. The pressure in the back pressure chamber 34 is high because the back pressure chamber 34 receives the pressure of the pressure accumulator 10 through the restrictor 83 and the fuel passage 61.

In this state, in the flow passage switching valve 70, the valve member 71 is positioned at the upper end position by the biasing force of the spring 74 because the pressure chamber 81 and the operation chamber 82 at the both ends of the valve member 71 receive the same pressure of the pressure accumulator 10 so that the pressures in the both chambers 81, 82 become the same high pressure. Thus, the communication between the upper circular groove 103 and the intermediate circular groove 104 is broken and the seat 72 is brought to a closed state. The lower circular groove 105 communicates with the intermediate circular groove 104, bringing the seat 73 to an opened state. Therefore, the high pressure of the pressure accumulator 10 is supplied to the control chamber 25 of the pressure intensifier 20 through the fuel passage 61, the circular groove 105 of the flow passage switching valve 70, the seat 73, the circular groove 104 and the fuel passage 76. The same pressure of the pressure accumulator 10 is also supplied to the high-pressure chamber 24 through the fuel passages 61, 64 and the check valve 40. Accordingly, the forces applied to the pressure intensifying piston of the pressure intensifier 20 from the upper and lower chambers are balanced. At that time, the piston 21 and the plunger 22 move upward in the illustration due to the force of the return spring 26. Thus, the high-pressure chamber 24 is replenished with the fuel. In this sate, the nozzle back pressure coincides with the pressure in the high-pressure chamber 24, i.e., the pressure in the pressure accumulator 10. Therefore, the injection nozzle 30 does not open, so the injection is not performed.

Then, if the electromagnetic coil 54 of the actuator 52 is energized, the attraction is generated and the valve member 51 of the control valve 50 starts moving upward in the illustration. FIG. 3 shows a state after the movement. The control valve 50 is open and the back pressure chamber 34 communicates with the pressure release passage 62 on a drain side through the fuel passage 65, the restrictor 84 and the fuel passage 67. The restrictor 84 is set larger than the restrictor 83 communicating with the pressure accumulator 10. Therefore, the pressure in the back pressure chamber 34 is released due to the valve opening of the control valve 50. Thus, the balance of the oil pressure applied to the needle valve 31 is broken so that the upward force becomes larger than the downward force. If the upward force exceeds the biasing force of the spring 33 and the injection nozzle 30 opens, the fuel is injected from the injection hole 35.

The flow passage switching valve 70 is kept in a state in which the valve member 71 blocks the seat 72 until the pressure in the back pressure chamber 34 decreases to a predetermined pressure. Therefore, the pressure in the control chamber 25 of the pressure intensifier 20 remains high. The large diameter piston 21 and the small diameter plunger 22 remain stopped. Accordingly, the injection pressure at that time substantially coincides with the pressure of the pressure accumulator 10.

Figure 4:
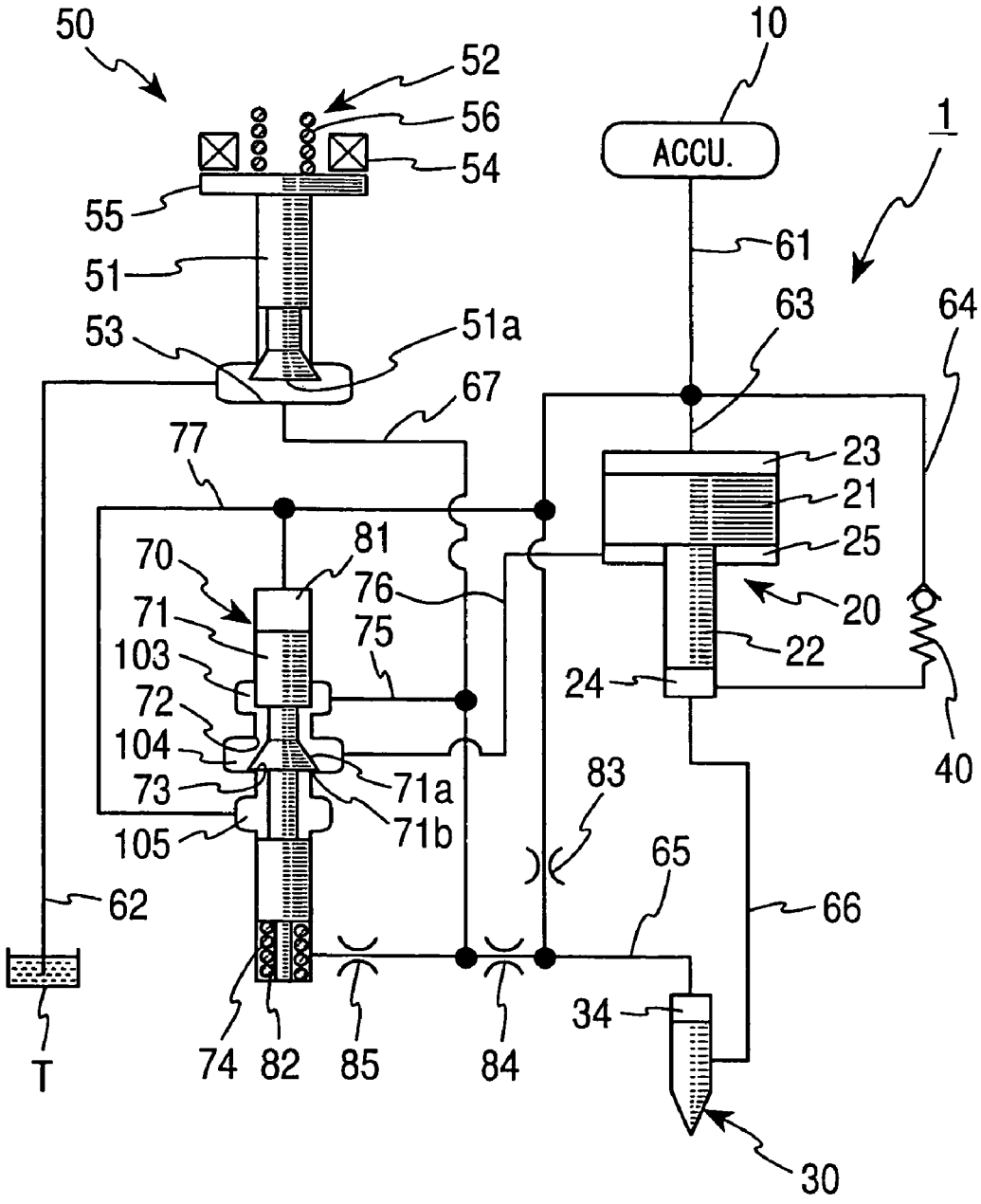
FIG. 4 is a schematic diagram showing a pressure intensification controlling state of the fuel injection device according to the FIG. 1 embodiment.

If the pressure of the back pressure chamber 34 is released further, the valve member 71 of the flow passage switching valve 70 moves to the lower end position as shown in FIG. 4. The pressure in the operation chamber 82 under the valve member 71 also decreases after the pressure in the back pressure chamber 34 is released with a predetermined delay set by the restrictor 85. If the pressure in the operation chamber 82 decreases to a predetermined pressure or lower, the valve member 71 moves downward due to the pressure difference across the both ends thereof against the spring 74. If the state shown in FIG. 4 is achieved, the upper circular groove 103 and the intermediate circular groove 104 of the flow passage switching valve 70 communicate with each other and the seat 72 is brought to an opened state. The lower circular groove 105 is disconnected from the intermediate circular groove 104 and the seat 73 is brought to a closed state. Therefore, the control chamber 25 of the pressure intensifier 20 communicates with the pressure release passage 62 through the fuel passage 67. Since the pressure of the control chamber 25 is released, the large diameter piston 21 and the small diameter plunger 22 start moving downward.

Due to the movement of the pressure intensifying piston, the pressure in the high-pressure chamber 24 starts increasing. Finally, the pressure in the high-pressure chamber 24 increases compared to the pressure in the drive chamber 23 at a ratio of the sectional area of the large diameter piston 21 to that of the small diameter plunger 22. For example, if the pressure in the pressure accumulator 10 is 130 MPa and the sectional area ratio is set at two, the pressure in the high-pressure chamber 24 increases to 260 MPa. The pressure-intensified fuel at extra-high pressure is injected from the injection nozzle 30.

By keeping the sate shown in FIG. 4 and advancing the pressure intensifying operation, the main injection at the extra-high pressure can be performed. When a minute amount injection is performed, the state is quickly returned from the sate shown in FIG. 3 to the state shown in FIG. 2. Thus, the injection at the low pressure can be performed before the pressure intensification starts.

When the injection is ended, the state is brought to the state shown in FIG. 2 by de-energizing the actuator 52 so that the control valve 50 is returned to the initial position. At that time, the flow passage switching valve 70 operates in retard of the valve closing of the control valve 50. Therefore, the flow passage switching valve 70 stays in a pressure intensifying state for a moment (shown in FIG. 4). However, the discharge is stopped because the control valve 50 as the discharge destination is closed. Moreover, the fuel supplied through the restrictors 83, 84 flows back from the seat 72 of the flow passage switching valve 70 in the closed state to the control chamber 25. Accordingly, the pressure supply to the control chamber 25 is started without any delay. Then, the operation of the valve member 71 starts after a delay. If the valve member 71 of the flow passage switching valve 70 moves in retard and the state shown in FIG. 2 is resumed, the seat 72 is brought to the closed state. However, the fuel is continuously supplied through the seat 73 in the opened state. Therefore, the fuel can be supplied to the control chamber 25 regardless of the state of the flow passage switching valve 70.

Thus, the injection operation and the pressure intensifying operation can be ended at the same time, realizing quick injection ending. The quick injection ending has an effect of reducing black smoke discharge from the engine as is well known.

Thus, the above-explained example embodiment exerts effects of improving fuel consumption of the internal combustion engine and suppressing energy loss by preventing wasteful discharge of a large amount. When the control valve 50 is open, the supply pressure communicates with the low-pressure circuit through several restrictors just instantly. However, the leakage at the injection is extremely small, causing just a small loss.

Figure 6:
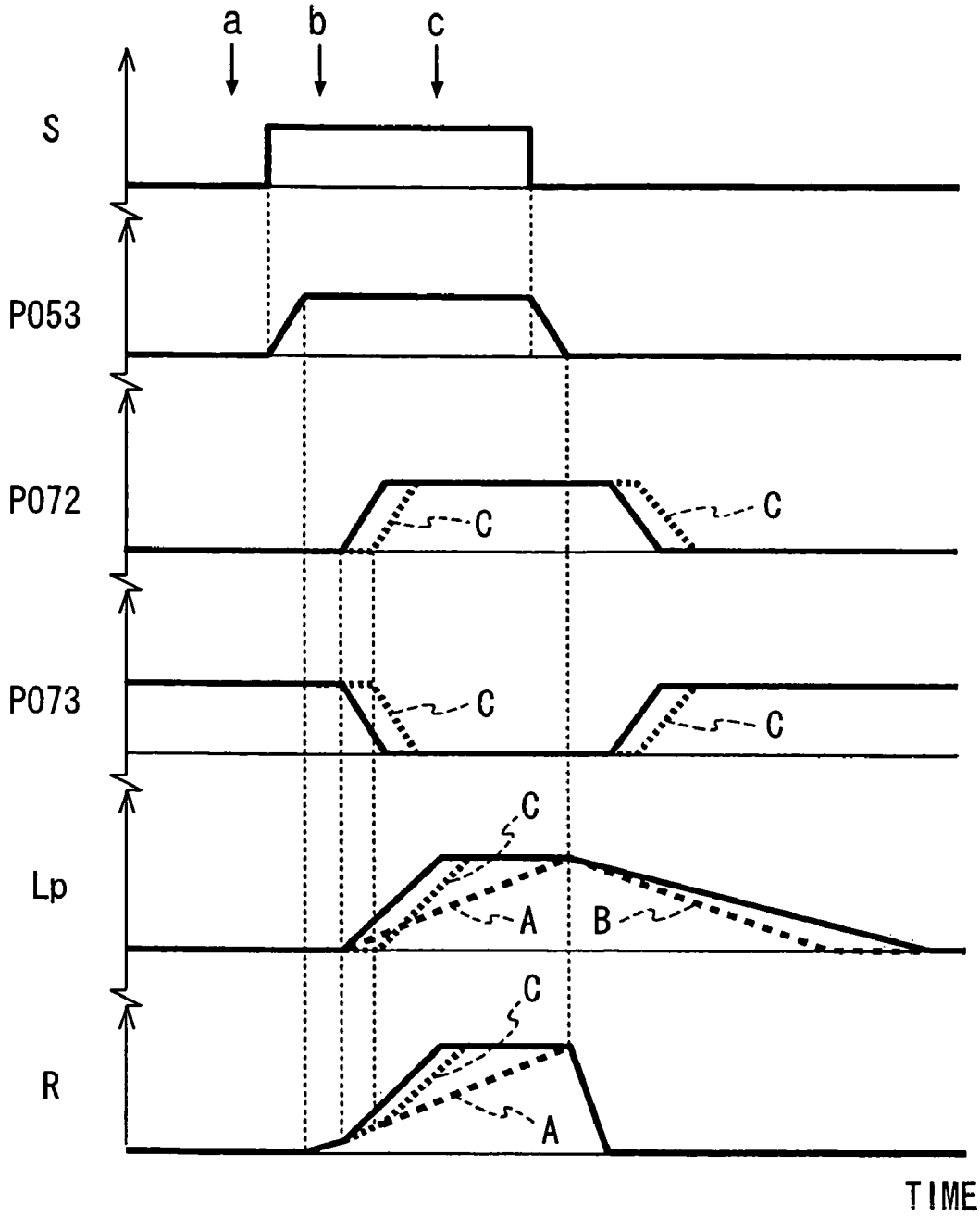
FIG. 6 is a time chart showing an operation of the fuel injection device according to the FIG. 1 embodiment.

FIG. 6 is a time chart showing an operation of the fuel injection device 1 according to the present example embodiment. Timing "a" corresponds to the initial state shown in FIG. 2. Timing "b" corresponds to the low-pressure injection state shown in FIG. 3. Timing "c" corresponds to the extra-high-pressure injection state shown in FIG. 4. If a drive signal S is output in the state "a", the control valve 50 operates and the flat seat 53 (back pressure release port) opens. A sign PO53 in FIG. 6 indicates the operation of the back pressure release port 53. Thus, the pressure in the back pressure chamber 34 of the injection nozzle 30 is released and the injection is started. A sign R in FIG. 6 indicates an injection ratio. At the timing "b", the flow passage switching valve 70 does not operate and the injection pressure remains low. Thereafter, if the flow passage switching valve 70 operates as shown in FIG. 4 and the seat 72 (pressure intensification release port) opens, the pressure intensifier 20 starts operation, starting the pressure intensification. A sign PO72 in FIG. 6 indicates the operation of the pressure intensification release port 72, and a sign PO73 indicates the operation of the seat 73 (pressure intensification pressurization port). A sign Lp indicates a lifting amount of the pressure intensifier 20. At the timing "c", the injection pressure becomes extra-high pressure. If the drive signal S is stopped when the injection amount becomes a predetermined value, the flat seat 53 of the control valve 50 is closed and the nozzle back pressure increases. Accordingly, the injection nozzle 30 is closed. At that time, the flow passage switching valve 70 operates in retard. However, as explained before, the fuel is supplied to the control chamber 25 regardless of the state of the flow passage switching valve 70. Therefore, the pressure intensification is immediately stopped and the returning stroke of the pressure intensifier 20 is started without delay.

In the present embodiment, the passage used when the pressure in the control chamber 25 of the pressure intensifier 20 is released is different from the passage used when the pressure intensification is performed. By using this feature, pressure increase speed at the pressure intensification can be changed by pressure releasing speed as shown by a broken line A in FIG. 6. Further, the returning speed of the pressure intensifier 20 can be changed with the pressurization speed. Moreover, a pressure intensification start phase can be changed by the restrictor 85 and the set pressure of the flow passage switching valve 70 as shown by a broken line C in FIG. 6. Thus, as shown by the broken lines A, C in FIG. 6, the injection ratio pattern can be changed in accordance with the pressure increase speed and the pressure intensification start timing. This optimization is effective in purifying the exhaust emission and improving the output of the internal combustion engine. As shown by a broken line B, the return speed of the pressure intensifier 20 can be changed. Thus, for example, setting such as acceleration of the return to the initial position during high-speed operation of the engine can be realized without affecting other properties.

Thus, the pressure in the early stage of the injection can be set low, and the period of the low-pressure state can be set by the restrictor 85 and the set pressure of the flow passage switching valve 70. In addition, when the minute amount injection that does not require extra-high pressure is performed, the injection can be performed without pressurizing the fuel because a period of the injecting state is extremely short. Due to the circuit structure, the wasteful discharge of the fuel is limited to the leak from the control valve 50 as the two-way valve during the injection. The pressure intensification and the injection can be ended at the same time. Accordingly, wasteful movement of the pressure intensifier 20, i.e., wasteful drive energy consumption, can be avoided.

Accordingly, in this example embodiment, extra-high pressure injection suppressing a loss can be realized and various injection patterns such as a low-pressure injection or an extra-high-pressure injection can be realized with a simple structure using a single control valve with a two-position actuator. Moreover, the operation of the pressure intensifier 20 can be optimized so that the above-explained optimum injection characteristics are built and the return time is optimized.

Figure 7:
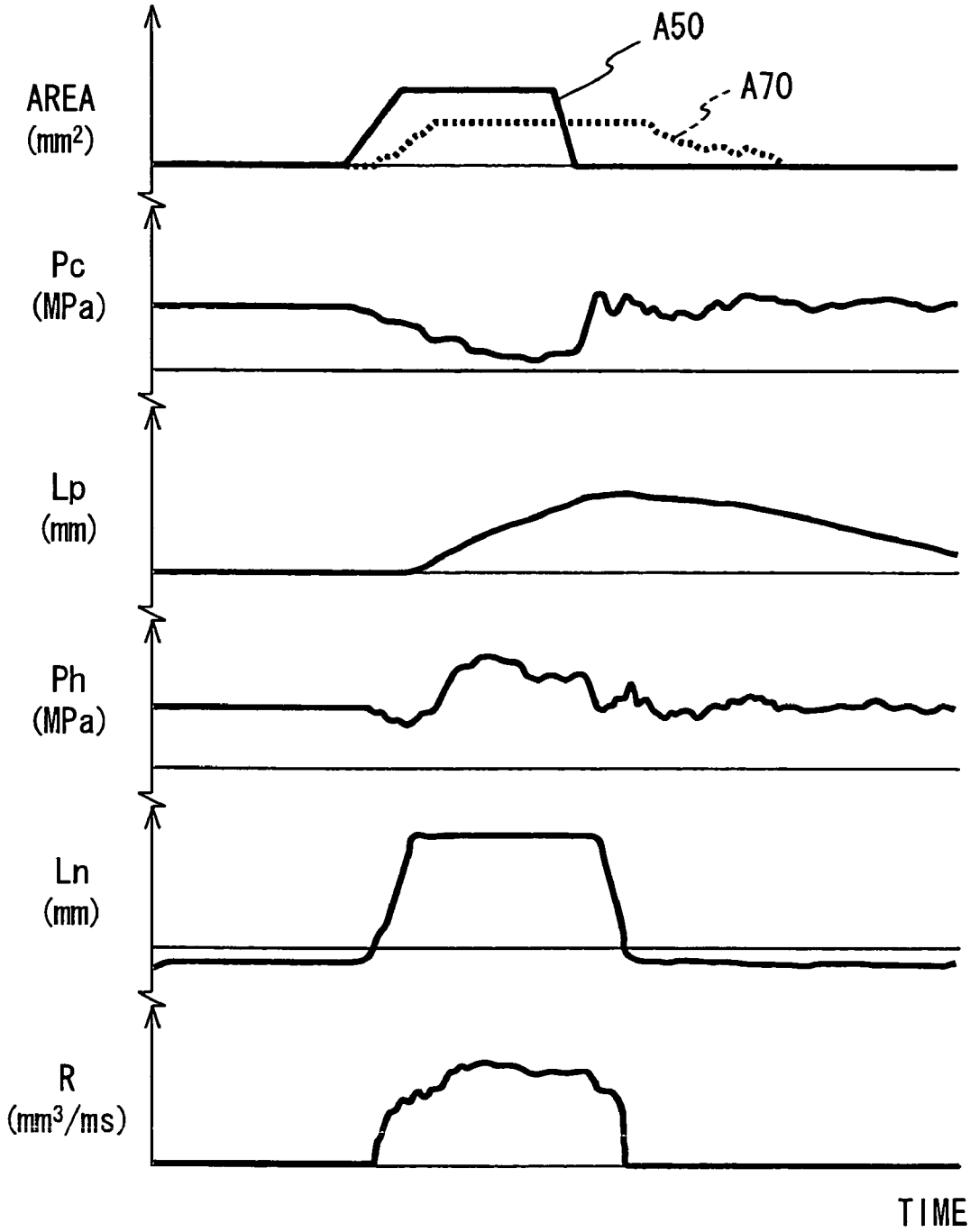
FIG. 7 is a diagram showing a numerical analysis result of the fuel injection device according to the FIG. 1 embodiment.

FIG. 7 shows an example of a numerical analysis result provided through computer simulation. A sign AREA in FIG. 7 represents an opening area of the flow passage switching valve 70 or the control valve 50. A solid line A50 indicates the opening area of the control valve 50 and a broken line A70 indicates the opening area of the flow passage switching valve 70. A sign Ln in FIG. 7 indicates a lifting amount of the needle valve 30, a sign Pc in FIG. 7 is the pressure in the control chamber 25, and a sign Ph in FIG. 7 is the pressure in the high-pressure chamber 24. As shown in FIG. 7, the flow passage switching valve 70 starts operation in retard of the control valve 50. When the injection is started, the pressure intensifying piston does not operate and the pressure Ph in the high-pressure chamber 24 is low. Thereafter, the pressure intensifying piston lifts and the pressure Ph in the high-pressure chamber 24 increases. Thus, injection characteristics, in which the injection ratio R is low in the early stage and increases thereafter, are realized. Moreover, though the flow passage switching valve 70 is positioned at the pressure intensifying position when the injection is ended, the pressure intensification is stopped and the returning is started at the same time as the end of the injection. Thus, it is ascertained that operation and performance substantially equal to the above-explained operation explained in reference to the schematic diagrams are obtained.

Figure 8:
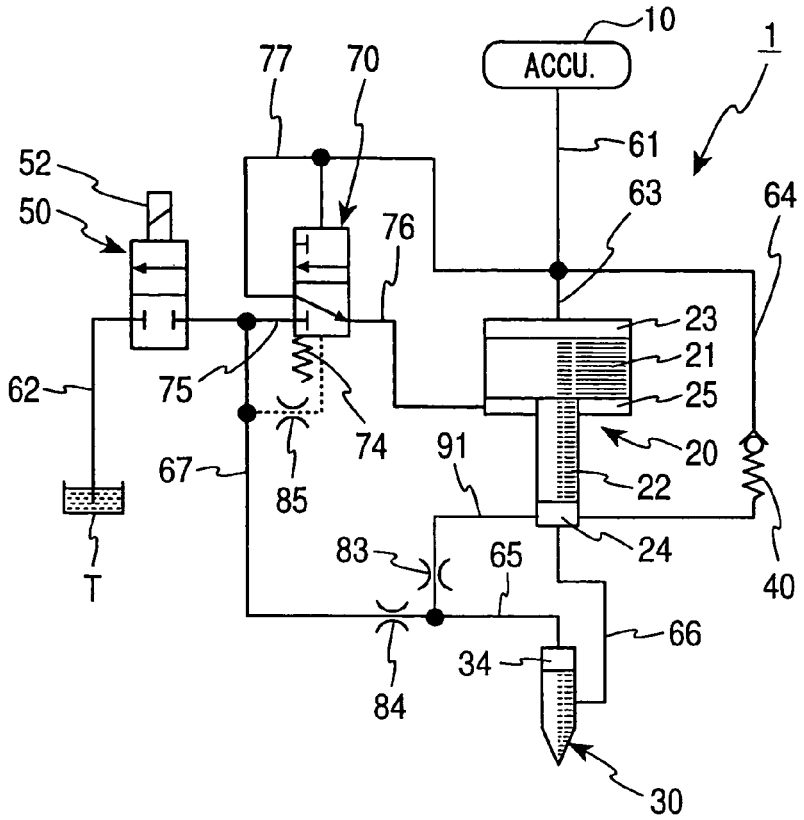
FIG. 8 is a schematic diagram showing a fuel injection device according to a second example embodiment of the present invention.

Next, a structure according to a second example embodiment of the present invention will be explained in reference to FIG. 8. The basic structure according to the second example embodiment is similar to that of the first example embodiment. A difference between the present embodiment and the first example embodiment is a structure of a supply passage leading to the back pressure chamber 34 of the injection nozzle 30. In the first example embodiment, the fuel passage 65 as the supply passage of the nozzle back pressure is connected to the fuel supply passage 61 leading to the pressure accumulator 10. In the present embodiment, a fuel passage 91 leading to the high-pressure chamber 24 of the pressure intensifier 20 is provided and is connected with the fuel passage 65 through the restrictor 83. The other structure is similar to that of the first example embodiment.

In the structure according to the present embodiment, the extra-high pressure is supplied from the high-pressure chamber 24 to the back pressure chamber 34 when the injection is ended. Thus, the operation pressure becomes high pressure so that the operation ending is ensured. Also in this structure, the high pressure does not remain in the stable period after the injection ending. The pressure at the respective points coincides with the pressure of the pressure accumulator 10. Thus, the injection ending can be performed quickly while inhibiting the loss of drive energy.

Figure 9:
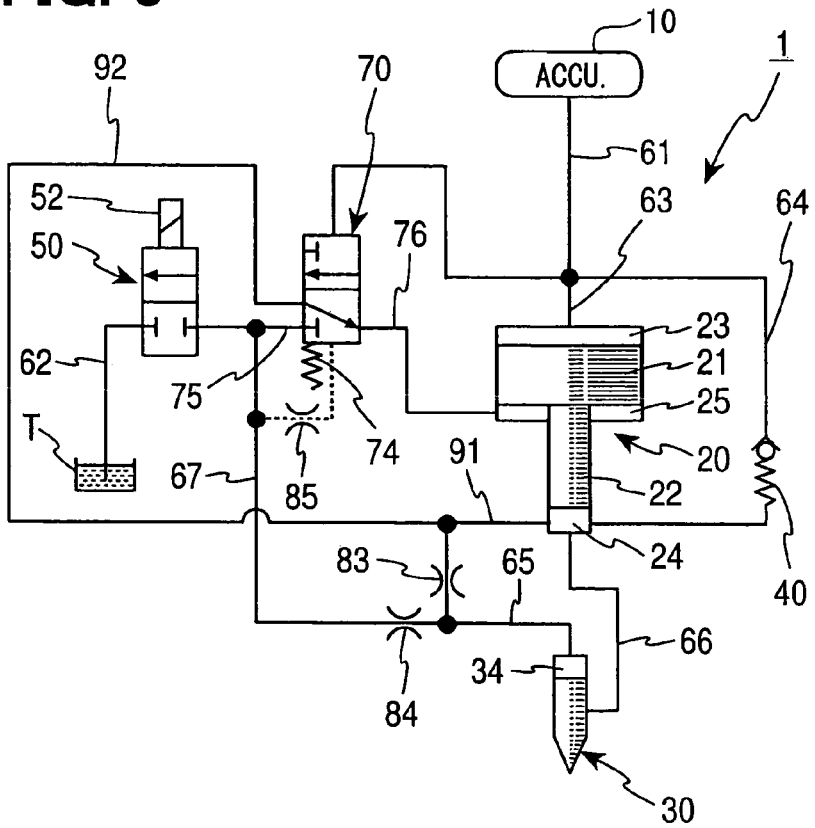
FIG. 9 is a schematic diagram showing a fuel injection device according to a third example embodiment of the present invention.

Next, a structure according to a third example embodiment of the present invention will be explained in reference to FIG. 9. The basic structure according to the third example embodiment is similar to that of the second example embodiment. A difference between the present embodiment and the second example embodiment is a passage structure of the supply port of the flow passage switching valve 70. In the second example embodiment, the supply port of the flow passage switching valve 70 is connected with the fuel supply passage 61 leading to the pressure accumulator 10 and the high pressure is supplied from the pressure accumulator 10 to the control chamber 25 of the pressure intensifier 20. In the present embodiment, a fuel passage 92 connected with the fuel passage leading to the high-pressure chamber 24 of the pressure intensifier 20 is provided and the high pressure is supplied to the supply port. The other structure is similar to that of the second example embodiment.

In the structure of the present embodiment, the extra-high pressure is supplied also to the control chamber 25 of the pressure intensifier 20. Thus, the ending of the pressure intensifying operation is ensured further. Moreover, like the second example embodiment, the extra-high pressure in the high-pressure chamber 24 is used in the injection control. Therefore, quick ending of the injection is realized by quickly reducing the injection pressure.

Figure 10:
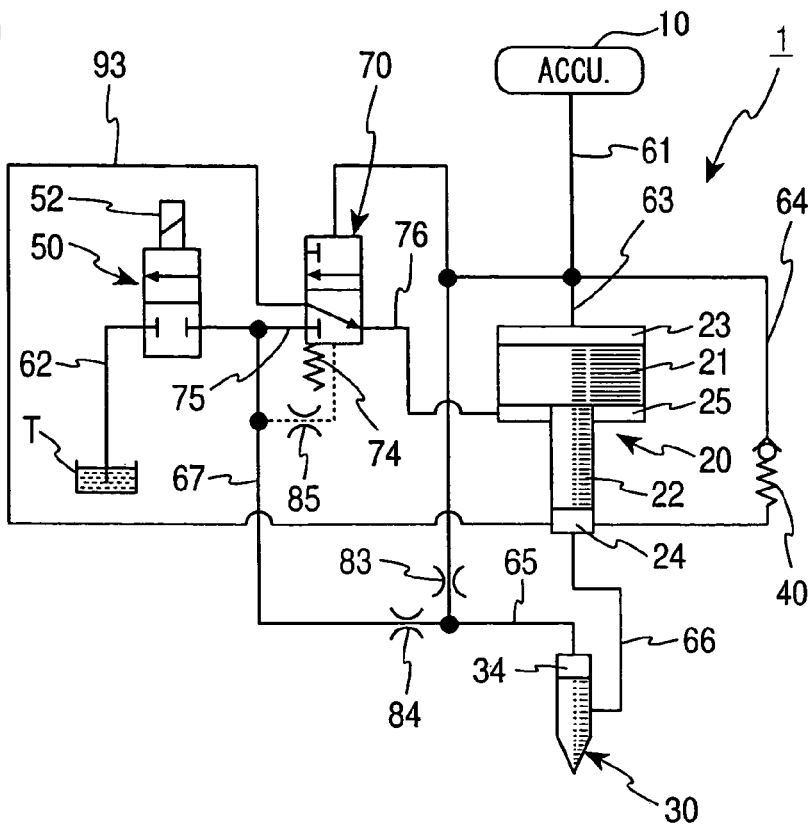
FIG. 10 is a schematic diagram showing a fuel injection device according to a fourth example embodiment of the present invention.
Figure 11:
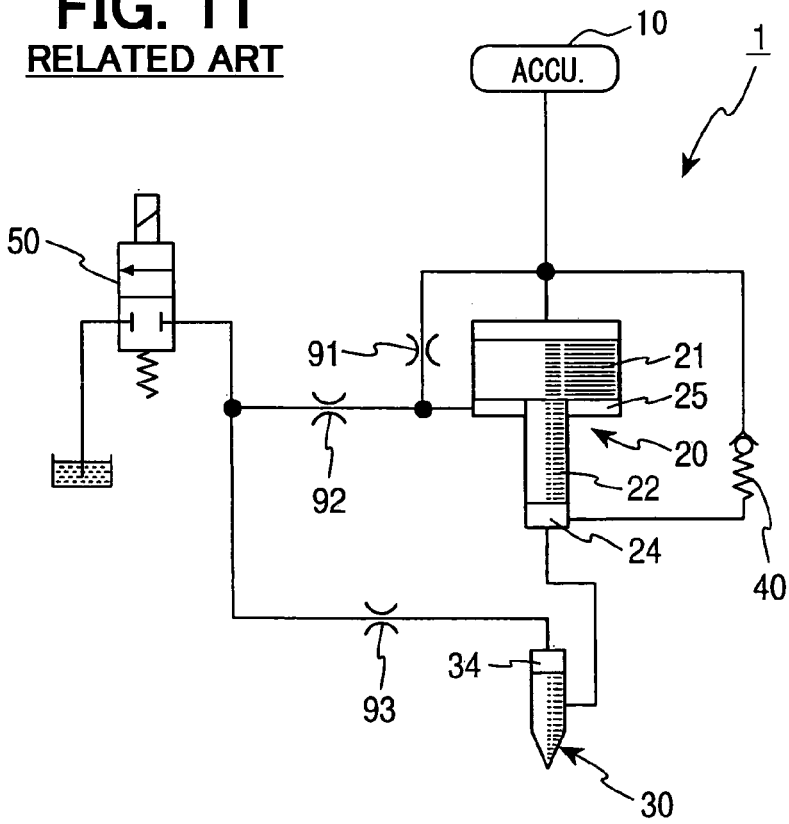
FIG. 11 RELATED ART
FIG. 11 is a schematic diagram showing a fuel injection device of a related art.

Next, a structure according to a fourth example embodiment of the present invention will be explained in reference to FIG. 10. The basic structure according to the fourth example embodiment is similar to that of the third example embodiment. A difference between the present embodiment and the third example embodiment is that the fuel passage 65 leading to the back pressure chamber 34 of the injection nozzle 30 is connected to the fuel supply passage 61 leading to the pressure accumulator 10 like the first example embodiment. The supply port of the flow passage switching valve 70 is connected with a fuel passage 93 leading to the high-pressure chamber 24 of the pressure intensifier 20 to supply the high pressure to the supply port. The other structure is similar to that of the third example embodiment.

In this example embodiment, the supply source of the nozzle back pressure is provided by the pressure accumulator 10 instead of the high-pressure chamber 24. The control force is reduced but there is no need to discharge the high pressure from the high-pressure chamber 24. Thus, energy loss is reduced. Like the third example embodiment, the extra-high pressure is supplied from the high-pressure chamber 24 to the control chamber 25 of the pressure intensifier 20. Thus, the ending of the pressure intensifying operation can be further ensured.

Thus, the supply source for the back pressure chamber 34 of the injection nozzle 30 and the supply port of the flow passage switching valve 70 may be selected from the pressure accumulator 10 and the high-pressure chamber 24. By combining the pressure accumulator 10 and the high-pressure chamber 24, desired characteristics and energy loss reduction effect can be exerted.

The present invention should not be limited to the disclosed embodiments, but may be implemented in many other ways without departing from the spirit of the invention.

What is claimed is:

1. A fuel injection device for an internal combustion engine, the fuel injection device comprising:

a pressure accumulator that accumulates fuel under pressure;

a pressure intensifier that operates a pressure intensifying piston with oil pressure in a control chamber to intensify the pressure of the fuel supplied from the pressure accumulator to a high-pressure chamber;

an injection nozzle that injects the fuel supplied directly from the pressure accumulator or the fuel, the pressure of which is intensified by the pressure intensifier, the injection nozzle structured so that oil pressure in a back pressure chamber of the injection nozzle controls opening and closing of the injection nozzle;

a control valve that controls the pressure intensifying operation of the pressure intensifier and the injection operation of the injection nozzle, wherein the control valve is a single two-way control valve driven by a two-position actuator and directly controls the oil pressure in the back pressure chamber to control the injection operation of the injection nozzle; and a flow passage switching valve that has a two-position three-way valve structure operated by control pressure controlled by the control valve, wherein the control chamber is selectively connected with a supply passage extending from a pressure supply source or with a pressure release passage leading to a low-pressure system through the flow passage switching valve to indirectly control the oil pressure of the control chamber so that the pressure intensifying operation of the pressure intensifier is controlled, the flow passage switching valve is structured so that a start of the operation thereof is delayed until the control pressure decreases to a predetermined operation pressure when the pressure is released from the control chamber to perform the pressure intensifying operation, so the pressure intensifying operation starts in retard of the injection operation, and the control chamber is supplied with pressure through the pressure release passage during a delay of the operation of the flow passage switching valve with respect to the operation of the control valve when the pressure is supplied to the control chamber to stop the pressure intensifying operation, so the pressure intensifying operation is stopped and a returning operation of the pressure intensifying piston is performed abreast of stoppage of the injection operation.

2. The fuel injection device as in claim 1, wherein the control valve opens and closes the pressure release passage leading to the low-pressure system and releases the pressure in the control chamber to the low-pressure system through the flow passage switching valve to make the pressure intensifying piston perform the pressure intensifying operation.

3. The fuel injection device as in claim 1, wherein the flow passage switching valve is formed with a switching port connected with the control chamber, a supply port connected with the supply passage extending from the pressure supply source and a release port connected with the control valve and has a valve member that connects and disconnects the switching port, the supply port and the release port.

4. The fuel injection device as in claim 3, wherein the valve member of the flow passage switching valve is operated by a pressure difference between pressure in a control port of the control valve and pressure in the pressure accumulator.

5. The fuel injection device as in claim 1, wherein the pressure supply source communicates with the control chamber through the flow passage switching valve regardless of a switching position of the flow passage switching valve when the control valve is in a closed state.

6. The fuel injection device as in claim 1, wherein the pressure in the control chamber is controlled to high pressure or low pressure by a switching position of the flow passage switching valve when the control valve is in an opened state.

7. The fuel injection device as in claim 1, wherein the pressure is supplied from the pressure accumulator as the pressure supply source to the control chamber through the flow passage switching valve.

8. The fuel injection device as in claim 1, wherein the pressure is supplied from the high-pressure chamber as the pressure supply source to the control chamber through the flow passage switching valve.

9. The fuel injection device as in claim 1, wherein the pressure is supplied from the pressure accumulator as the pressure supply source to the back pressure chamber of the injection nozzle.

10. The fuel injection device as in claim 1, wherein the pressure is supplied from the high-pressure chamber as the pressure supply source to the back pressure chamber of the injection nozzle.

11. The fuel injection device as in claim 1, wherein the back pressure chamber of the injection nozzle is connected with a fuel passage that branches into two passages connected with the pressure supply source and the control valve respectively.

12. A control method of a fuel injection device of an internal combustion engine, the method comprising:

a first step of opening a control valve to connect a back pressure chamber of an injection valve with a low-pressure system so that pressure is released from the back-pressure chamber and the injection nozzle is opened, starting an injection operation;

a second step of operating a switching valve to connect a control chamber of a pressure intensifier with the low-pressure system through the control valve so that the pressure intensifier starts a pressure intensifying operation of fuel supplied to the injection nozzle; and a third step of closing the control valve to disconnect the back pressure chamber and the control chamber from the low-pressure system to stop the injection operation and the pressure intensifying operation and to start a returning operation of the pressure intensifier at the same time.

* * * * *